US005896588A

United States Patent [19]

Chiang

[11] Patent Number: 5,896,588

[45] Date of Patent: Apr. 27, 1999

[54] SWIMMING GOGGLE STRUCTURE

[76] Inventor: Herman Chiang, 11F-2, No.634-9, Ching-Ping Rd., Chung-Ho City, Taipei Hsien, Taiwan

[21] Appl. No.: 08/891,683

[22] Filed: Jul. 11, 1997

[51] Int. Cl.[6] ..... A61F 9/02

[52] U.S. Cl. ..... 2/428; 2/440; 2/452

[58] Field of Search ..... 2/428, 429, 430, 2/447, 440, 452, 445, 9, 421, 15; 351/43; 128/858

[56] References Cited

U.S. PATENT DOCUMENTS

| | | | |
|---|---|---|---|
| 5,515,551 | 5/1996 | Yashiro | 2/428 |
| 5,734,995 | 4/1998 | Chiang | 2/445 X |
| 5,764,334 | 6/1998 | Berke | 2/447 X |

*Primary Examiner*—Peter Nerbun
*Attorney, Agent, or Firm*—Pro-Techtor International Services

[57] ABSTRACT

A swimming goggle structure includes two frames each having a lens fixed thereon, two cushion pads each mounted to one of the frames and adapted to contact wearer's face, a bridge connected between inner sides of the frames and a head strip connected between outer sides of the frames. Each of the cushion pads has a connection device which includes an extension section extending from an outer side of the cushion pad and having a substantial length to define a free end away from the outer side of the extension section. A fastener is mounted on the free end of the extension section to connect the head strip. By the provision of the connection device, the connection of the head strip to the lens frames of the swimming goggles is located at a position away from the outer canthus of the wearer so as to allow the force caused by the tension of the tightened head strip to be more uniformly distributed along the lens frames and thus providing a more comfortable and more leakage proofness engagement between the lens frames and the wearer's face.

17 Claims, 6 Drawing Sheets

SWIMMING GOGGLE STRUCTURE

FIELD OF THE INVENTION

The present invention relates generally to swimming goggles and in particular to a swimming goggle structure which provides a more comfortable and more compliant engagement with the wearer's face.

BACKGROUND OF THE INVENTION

Swimming goggles are comprised of two frames each having a lens fixed thereon. The frames have an inward facing side which is to be in sealing or leakage proof contact engagement with the wearer's face in order to prevent water from entering the space between the frames and the wearer's face. To provide a comfortable engagement between the frames and the wearer's face, soft and resilient pads are provided on the frames to be sandwiched between the frames and the wearer's face. Such pads may be made of a number of materials and in a numer of wayes.

For example, in FIG. 1 which shows a prior art swimming goggle structure, the pads are made of foam material 32 which are attached to the frames 31 of the swimming goggles. FIG. 2 shows another prior art design of swimming goggles, wherein the pads comprise a resilient ring 40 having a face contact flange 401 and received and held in an engaging slot 411 formed on the respective lens frame 41. In addition, conventionally, all swimming goggles are provided with a connection section on the outer side to connect a head strip, such as the connection section 33 or 43 formed on the lens frame 31 or 41 of the swimming goggles illustrated in FIGS. 1 and 2. The head strip 34 or 44 is secured to the connection sections 33 or 43 to allow the lens frames 31 or 41 to be fixed on the wearer's head.

The foam body 32 and face contact flange 401 adapted in the prior art swimming goggle designs, although effective in providing a comfortable engagement with the wearer's face, yet has a drawback that is the force caused by the tension induced in a tightened head strip when the swimming goggles are worn and acting upon the connection sections of the lens frames is generally concentrated in the areas of the wearer's face that are close to the connection sections, making the wearer uncomfortable to some extent. This may be further explained with reference to FIG. 2. Conventionally, the connection sections 43 are located close to the outer canthus of the wearer's eyes so that when the head strip 44 is tightened in wearing the swimming goggles, the tension of the head strip 44 causes a force acting upon each of the connection sections 43 which concentrates at the area of the wearer's face in the proximity of the eye canthus. The skin and muscle near the outer canthus are then stretched and strained, creating irritation.

In view of such a drawback present in almost all the prior art designs of swimming goggles, it is desirable to have an improved swimming goggle structure which reduces or substantially eliminates such an irritation problem caused by tightened head strip.

SUMMARY OF THE INVENTION

Therefore, a primary object of the present invention is to provide a swimming goggle structure which provides a more comfortable engagement with the wearer's face by locating the force concentrated area away from the canthus to more evenly distribute the force around the lens frame so as to achieve a comfortable and effective engagement between the lens frames and the wearer's eyes.

Another object of the present invention is to provide a swimming goggle structure which provides a better leakage proof engagement with the wearer's face by locating the force concentrated area induced by the tension of the head strip away from the canthus.

Thus, to achieve the above objects, in accordance with the present invention, there is provided a swimming goggle structure comprising two frames each having a lens fixed thereon, two resilient cushion pads each mounted to one of the frames and adapted to contact wearer's face in wearing the swimming goggles, a bridge connected between inner sides of the frames and a head strip connected between outer sides of the frames. Each of the cushion pads comprises connection means which comprises an extension section extending from outer side of the cushion pad and having a substantial length to define a free end away from the outer side of the cushion pad and the frame and a fastener mounted on the free end to connect the head strip.

In accordance with the swimming goggles provided by the present invention as described above, each of the cushion pads comprises a ring portion having an inner circumferential slot and a face contact portion extending from the ring portion in a direction toward the wearer's face for contact engagement with the wearer's face. The extension section extends from the ring portion to a location close to the ear of the wearer. Further, the fastener comprises at least one member made of a rigid material and having a connection hole for connecting the head strip.

The objects, advantages and features of the present invention will be apparent from the following description of the preferred embodiments thereof, with reference to the attached drawings, wherein:

DETAILED DESCRIPTION OF THE PREFERRED EMBODIMENTS

Figure 1:
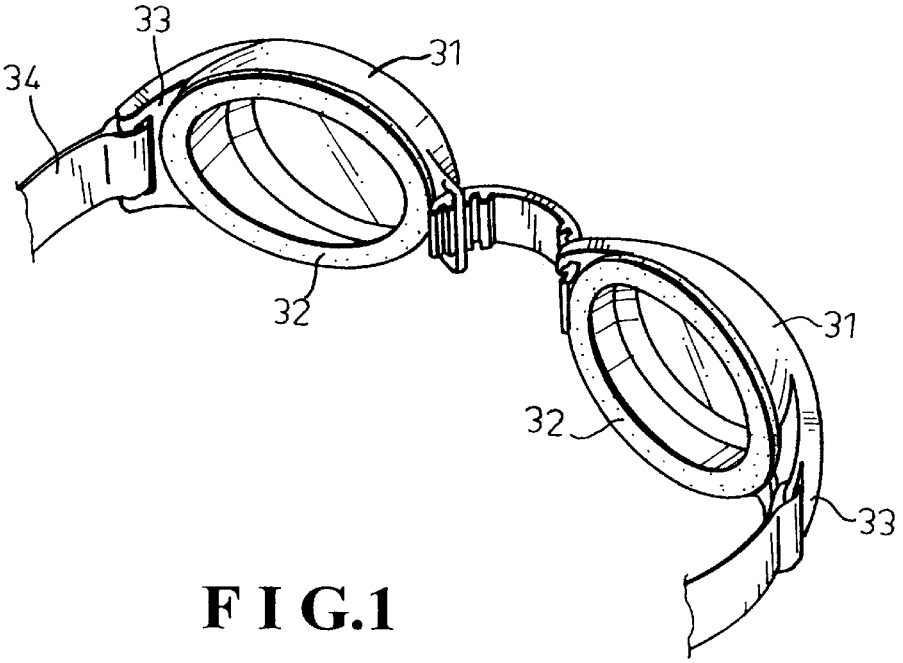
FIG. 1 is a perspective view showing a portion of a pair of prior art swimming goggles.
Figure 2:
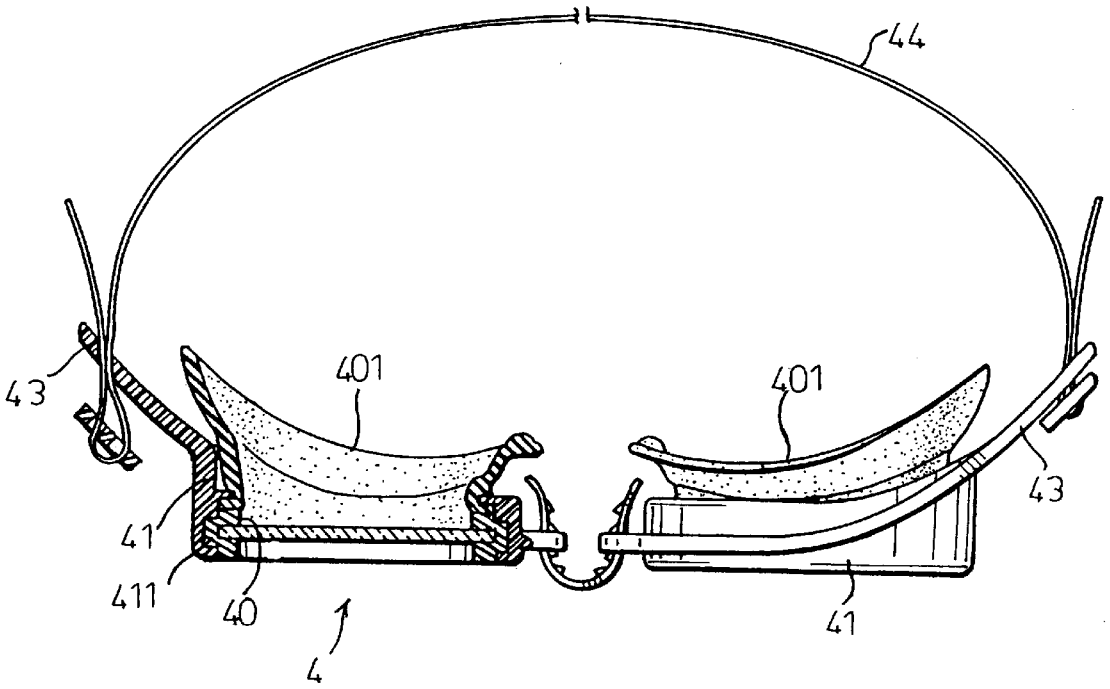
FIG. 2 is a top view, partially sectioned, showing another pair of prior art swimming goggles.
Figure 3:
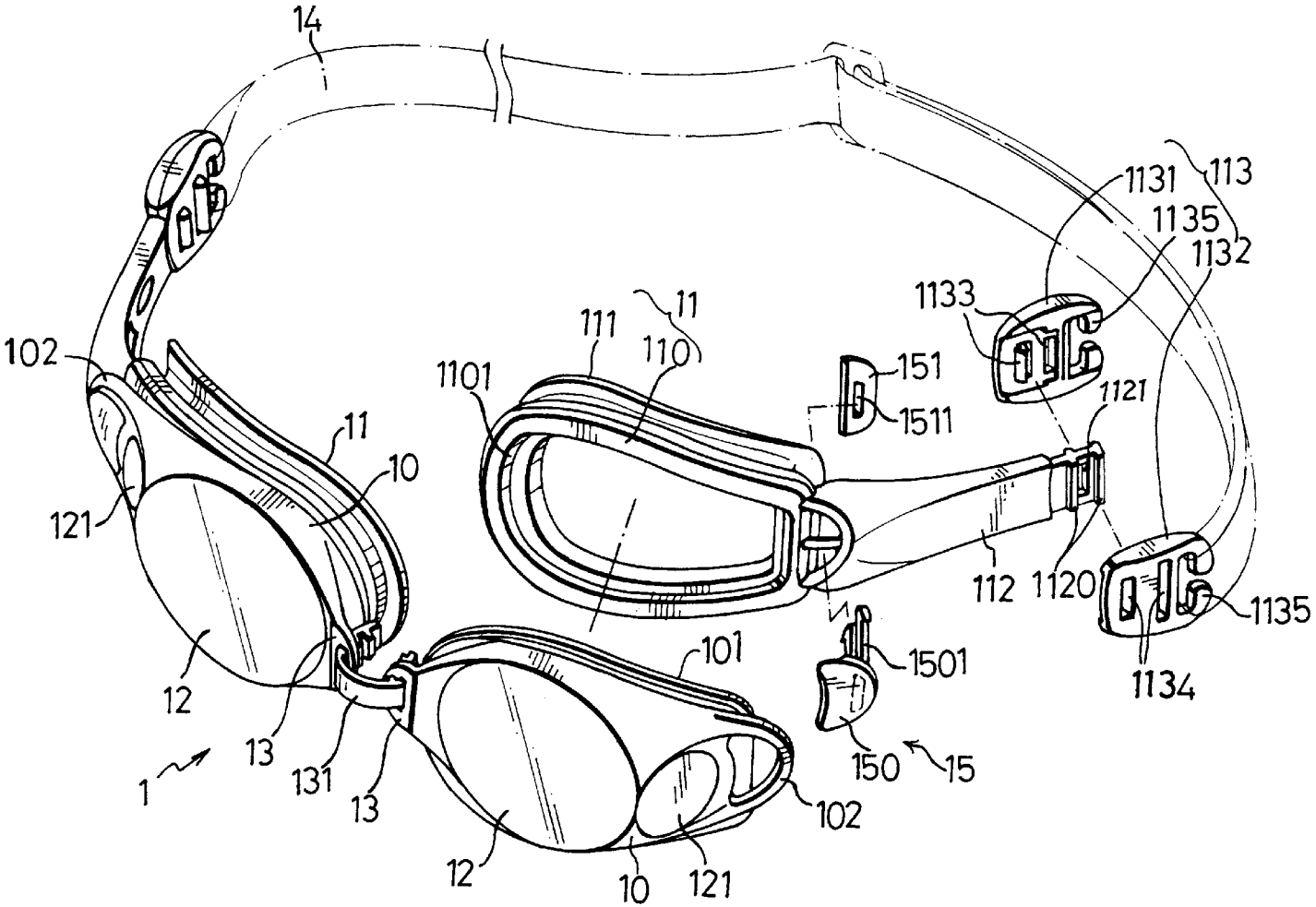
FIG. 3 is an exploded perspective view showing a pair of swimming goggles constructed in accordance with a first embodiment of the present invention.
Figure 4:
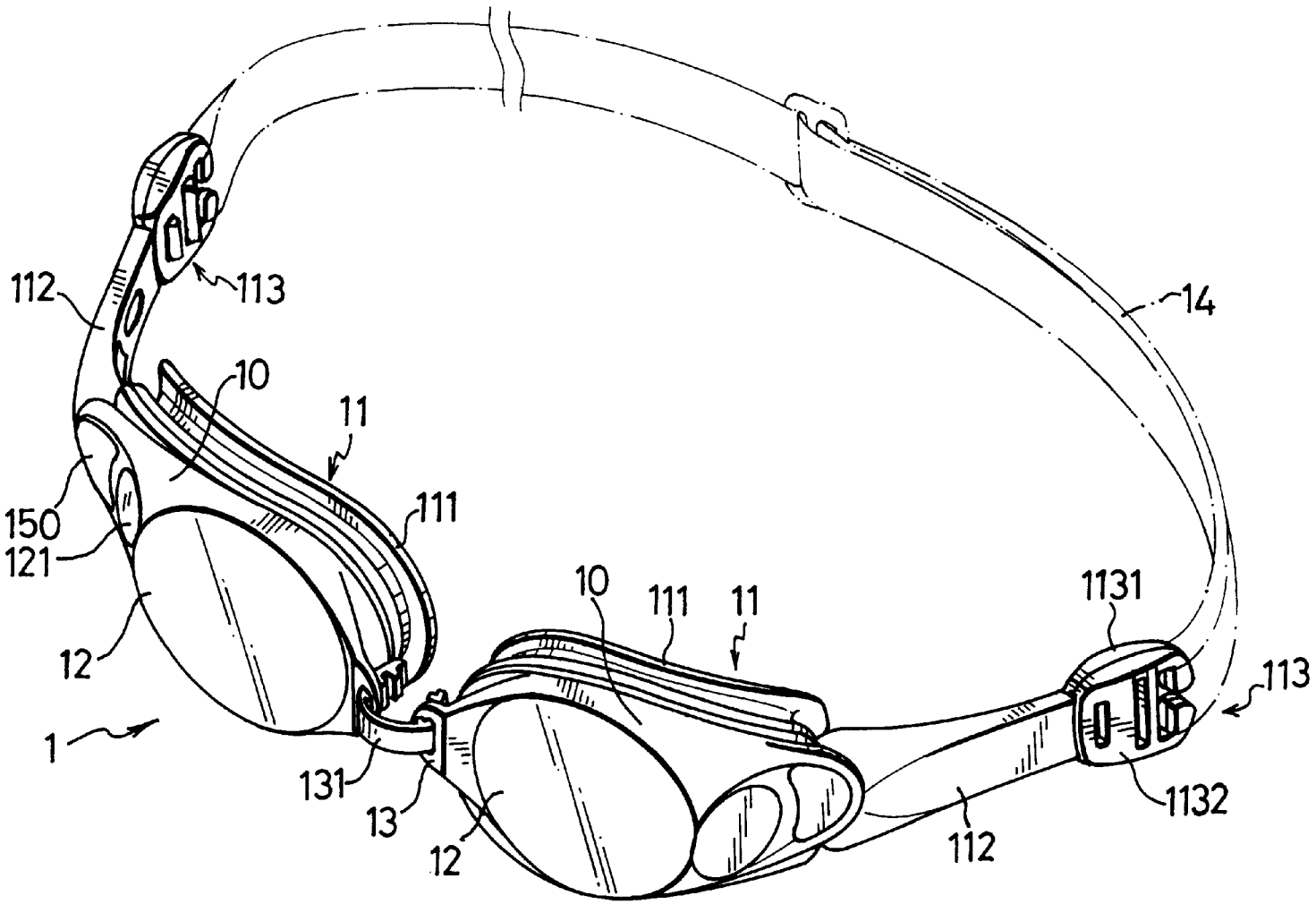
FIG. 4 is a perspective view of the swimming goggles of the first embodiment of the present invention.

Referring to the drawings and in particular to FIGS. 3 and 4, wherein a pair of swimming goggles constructed in accordance with a first embodiment of the present invention, generally designated with reference numeral 1, is shown, the swimming goggles 1 comprise two frames 10, two ring-like resilient cushion pads 11, two lenses 12, a bridge 13, a head strip 14 and auxiliary fasteners 15. Each of the frames 10 has one of the lenses 12 fixed thereon and preferably, the lens 12 is integrally formed with the respective frame 11 for example by means of molding process. Each of the frames 10 comprises a circumferential rib 101 to be received within an inner circumferential slot 1101 of the respective cushion pad 11 for holding the cushion pad 11 on the frame 10. The frame 10 is provided with a side view window 121 which is formed on a side wall of the frame 10 for increasing the view field of the wearer of the swimming goggles 1. A ring 102 is formed on the outer side of the frame 10 and extending from the side view window 121 for engaging the auxiliary fastener 15. The bridge 13 comprises a slot formed on the inner side of the frame 10 with a adjustable strip 131 extending therethrough to link the two frames 10 together.

The cushion pads 11 are made of soft and resilient material in order to provide a comfortable contact engagement with the wearer's face, comprising a ring portion 110 and a face contact portion 111, wherein the inner circumferential slot 1101 that is to receive the circumferential rib 101 of the respective frame 10 is formed along the ring portion 110. The face contact portion 111 extends from the ring portion 110 in a direction toward the wearer's face and having an elastically deformable flange to provide a comfortable contact engagement with the wearer's face. The ring portion 110 has formed on one side thereof a connection means which comprises an extension section 112 and a fastener 113. The extension section 112 is made of the same material of the cushion pad 11 and extends from the outer side of the ring portion 110, having a length such as to have the free end thereof close to the ear of the wear when the swimming goggles are worn. At the connection of the extension section 112 and the ring portion 110, a through hole is formed and shaped to correspond to the ring 102 of the respective frame 10.

Two reinforcing ribs 1120 are provided at the free end of the extension section 112, extending in a direction substantially normal to the length of the extension section 112, with a receiving hole 1121 formed between the two ribs 1120 to engage the fastener 113. The fastener 113 is mounted on the free end of the extension section 112 for connecting the head strip 14 (shown in phantom lines) to the frame 10. The fastener 113 comprises a first piece 1131 and a second piece 1132. The first piece has a through hole 1133 formed thereon. The second piece has a catching member 1134 sized to extend through the receiving hole 1121 of the extension section 112 in order to engage the through hole 1133 of the first piece 1131 so as to secure the fastener 13 on the free end of the extension section 112. The first and second fastener pieces 1131 and 1132 have a C-shape fastener 1135 formed on the end thereof for receiving the head strip 14 to extend therethrough.

The auxiliary fastener 15 comprises a surface plate 150 and a back plate 151 wherein the surface plate 150 has a configuration corresponding to the ring 102 of the lens frame 10 to be snugly received therein. However, the surface plate 150 may be made to have different configurations corresponding to different configurations of the ring 102 of the frame 10 so as to provide an aesthetic appearance of the swimming goggles 1. The surface plate 150 is provided with engaging pins 1501 which has pawed end to engage a slot 1511 formed on the back plate 151 so as to fix the auxiliary fastener 15 on the frame 10 of the swimming goggles 1.

In assembling the swimming goggles 1 in accordance with the present invention, as shown in FIG. 3, the ring portion 110 of each of the cushion pads 11 is first mounted to the respective frame 10 by having the inner circumferential slot 1101 of the cushion pad 11 fit over the circumferential rib 101 of the frame 10. The engaging pins 1501 of the surface plate 150 of the auxiliary fastener 15 is then inserted through the ring 102 of the frame 10 and the hole formed on the connection of the extension section 112 and the cushion pad 11 to engage the slot 1511 of the back plate 151, see FIG. 6, so as to more securely hold the cushion pad 11 on the frame 12. The first and second pieces 1131 and 1132 of the fastener 13 are then mounted to the free end of the extension section 112 to provide the C-shaped fastener 1135 on the extension section 112 for connecting the head strip 14, as shown in FIGS. 4 and 5.

Figure 5:
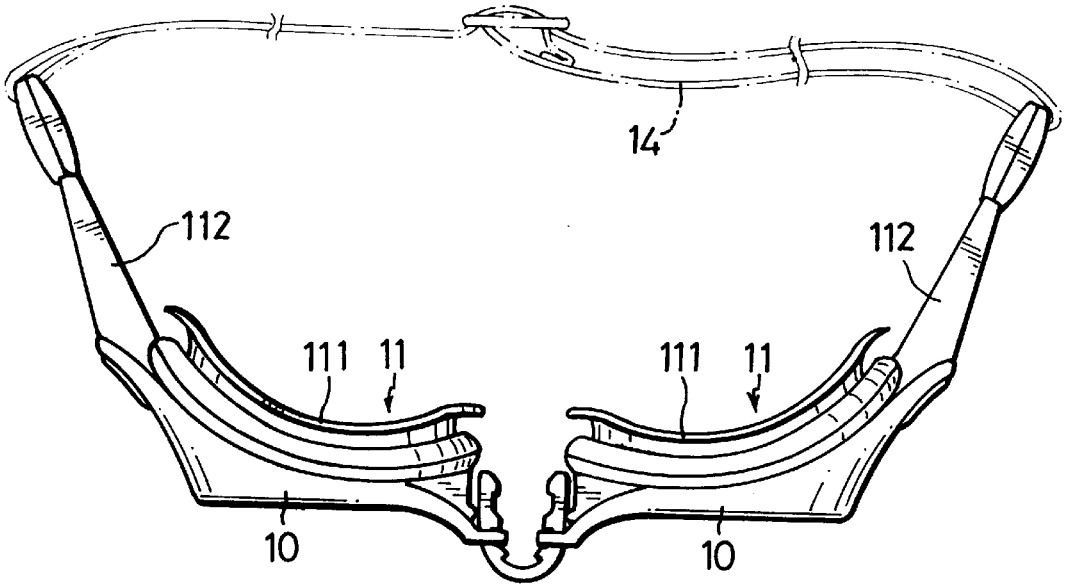
FIG. 5 is a top view of the swimming goggles of the first embodiment of the present invention.
Figure 6:
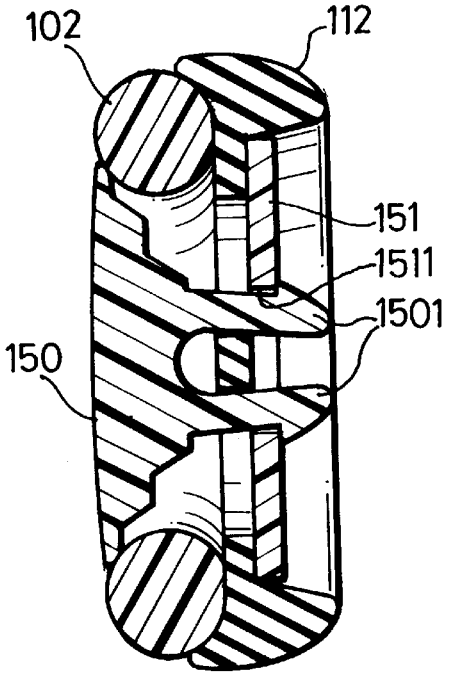
FIG. 6 is a cross-sectional view of the auxiliary fastener, together with the back plate, of the swimming goggles of the first embodiment of the present invention.

As shown in FIG. 5, in the swimming goggles 1 in accordance with the present invention, the connection between each of the frames 10 and the head strip 14 is located in the proximity of the ear of the wear, which is away from the outer canthus of the wearer as compared with the prior art designs, so that the force caused by the tension of the tightened head strip 14 may be more uniformly distributed along the frame 10, not simply concentrated at the outer canthus, so as to make the wearer feel more comfortable. Further, due to the more uniform distribution of the force along the frame 10, a better compliance and thus better leakage proofness may be achieved between the frame 10 and the wearer's face.

Figure 7:
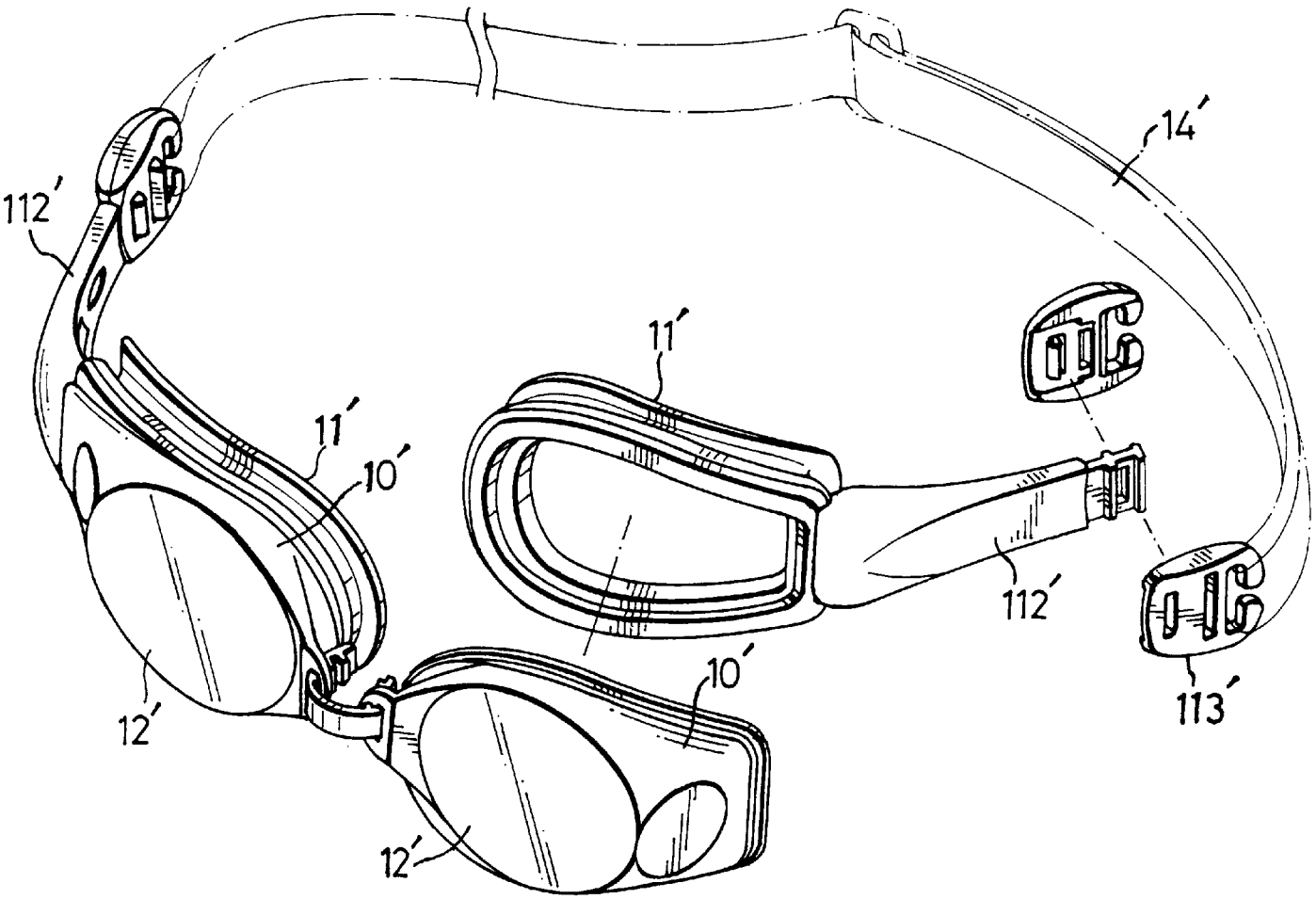
FIG. 7 is a perspective view, partially exploded, showing a pair of swimming goggles constructed in accordance with a second embodiment of the present invention.

With reference to FIG. 7, which shows a pair of swimming goggles constructed in accordance with a second embodiment of the present invention, the second embodiment swimming goggles, which are designated with reference numeral 1', are similar in structure to the first embodiment swimming goggles 1 in that the second embodiment swimming goggles 1' also comprises two frames 10' having fixed thereon lenses 12', two resilient cushion pads 11' mounted on an inward side of the frames 10' that faces the wearer, an extension section 112' formed on the outer side of each of the cushion pads 11' with a fastener 13' fixed on the free end thereof to connect a head strip 14' and a nose bridge 13' connecting between inner sides of the two frames 10'. However, the auxiliary fastener 15 that is used in the first embodiment swimming goggles 1 to further secure the cushion pad to the respective frame is eliminated for simplification of the overall structure.

Figure 8:
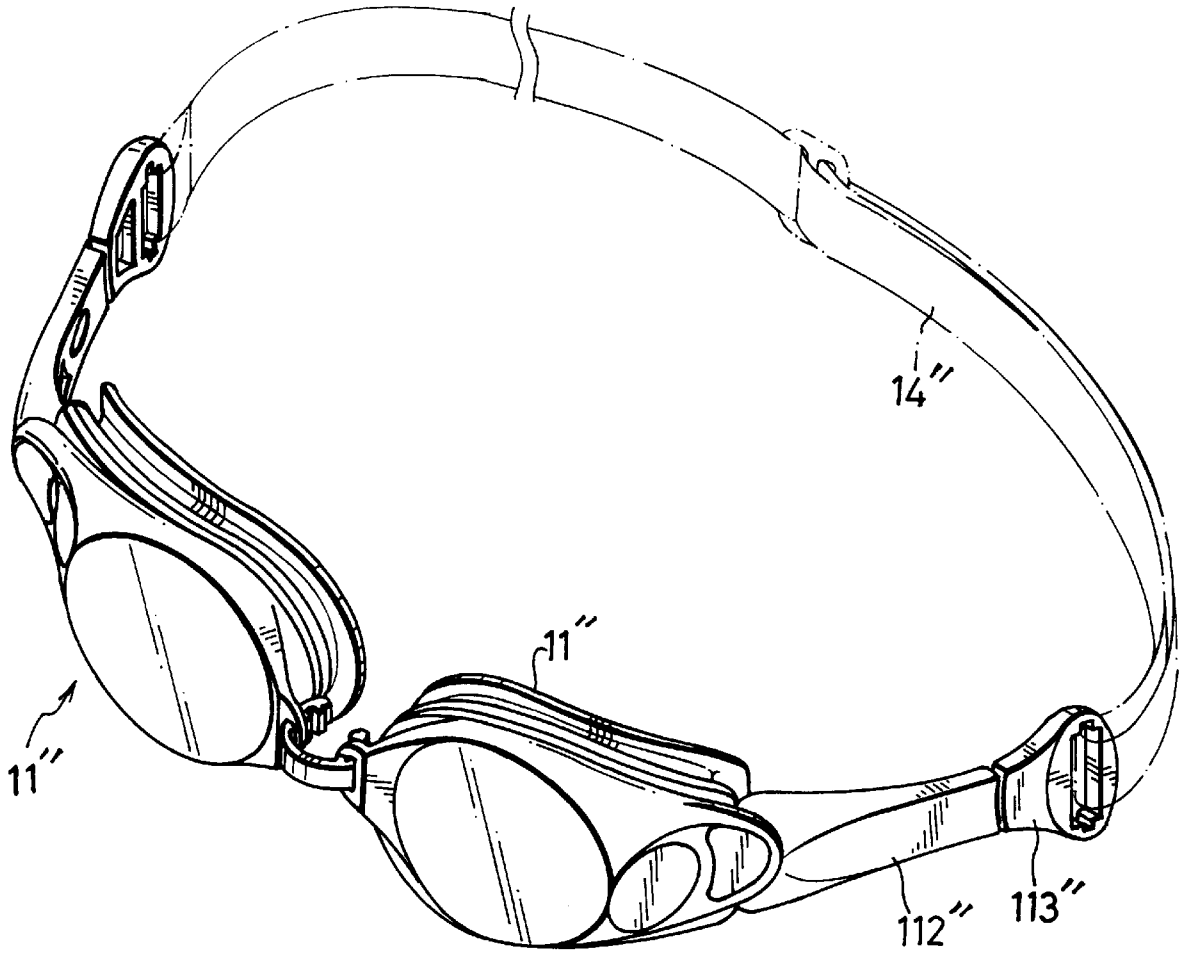
FIG. 8 is a perspective view showing a pair of swimming goggles constructed in accordance with a third embodiment of the present invention.

With reference to FIG. 8, which shows a pair of swimming goggles constructed in accordance with a third embodiment of the present invention, the third embodiment swimming goggles, which are designated with reference numeral 1", are similar in structure to the first embodiment swimming goggles 1 with the only exception that the extension section 112" that extends from each of the frames 11" comprises a fastener 113" that is integrally formed on the free end of the extension section 112", rather than being comprised of two pieces separate from and engageable with each other and to be fixed on the free end of the extension section as illustrated in the first and second embodiments. Preferably, the fastener 113" is made of a material having greater rigidity than that of the extension section 112" so as to provide a better resistance against the stretching of the head strip 14".

The above description is made with respect to the preferred embodiments of the present invention and for those skilled in the art, it is possible to make a variety of modifications and changes to the above-described specific embodiments without departing from the scope and spirit of the present invention. All these modifications and changes should be considered within the scope of the present invention as defined in the appended claims.

What is claimed is:

1. A swimming goggle structure comprising:

two frames each having a lens fixed thereon, two resilient cushion pads each mounted to one of the frames and adapted to contact a wearer's face, a bridge connecting inner sides of the frames, and a head strip connecting outer sides of the frames; wherein each of the cushion pads comprises a connection means which comprises an extension section extending from an outer side of the cushion pad and having a substantial length terminating in a free end, a fastener being mounted on the free end to connect to the head strip, and an auxiliary fastener securing the extension section of each of the cushion pads to the respective frame, the auxiliary fastener comprising a surface plate having an engaging pin to extend through holes formed on the frame and the extension section to be received and engaged by a slot formed on a back plate so as to secure the extension section to the frame.

2. The swimming goggle structure as claimed in claim 1, wherein each of the cushion pads comprises a ring portion having an inner circumferential slot and a face contact portion extending from the ring portion for contact engagement with the wearer's face, the extension section extending from the ring portion to a location close to an ear of the wearer.

3. The swimming goggle structure as claimed in claim 2, wherein the fastener comprises at least one member made of a rigid material and having a connection hole for connecting the fastener to the head strip.

4. The swimming goggle structure as claimed in claim 3, wherein the fasterner is integrally formed with the extension section.

5. The swimming goggle structure as claimed in claim 2, wherein the fastener comprises two pieces which are engageable with each other to sandwich the free end of the extension section therebetween so as to be secured to the extension section.

6. The swimming goggle structure as claimed in claim 3, wherein the fastener comprises two pieces which are engageable with each other to sandwich the free end of the extension section therebetween so as to be secured to the extension section.

7. The swimming goggle structure as claimed in claim 5, wherein the fastener comprises a first piece having a through hole formed thereon and a second piece having a catching member formed thereon to corresponded to the through hole of the first piece and wherein the extension section has a through hole formed thereon to allow the catching member of the second piece to extend therethrough and engage the through hole of the first piece so as to secure the fastener to the extension section.

8. The swimming goggle structure as claimed in claim 6, wherein the fastener comprises a first piece having a through hole formed thereon and a second piece having a catching member formed thereon to corresponded to the through hole of the first piece and wherein the extension section has a through hole formed thereon to allow the catching member of the second piece to extend therethrough and engage the through hole of the first piece so as to secure the fastener to the extension section.

9. The swimming goggle structure as claimed in claim 7, wherein the through hole of the extension section which receives the catching member of the second piece of the fastener therethrough comprises reinforcing ribs formed on the extension section and in the proximity thereof to prevent the through hole from being significantly deformed in connecting the head strip.

10. The swimming goggle structure as claimed in claim 8, wherein the through hole of the extension section which receives the catching member of the second piece of the fastener therethrough comprises reinforcing ribs formed on the extension section and in the proximity thereof to prevent the through hole from being significantly deformed in connecting the head strip.

11. The cushion pad as claimed in claim 10, wherein the extension section extends from the ring portion to a location close to ear of the wearer, the fastener comprises at least one member made of a rigid material and having a connection hole for connecting the head strip, the fastener being integrally formed with the extension section, and wherein the fastener comprises two pieces which are engageable with each other to sandwich the free end of the extension section therebetween so as to be secured to the extension section.

12. The cushion pad as claimed in claim 11, wherein the fastener comprises a first piece having a through hole formed thereon and a second piece having a catching member formed thereon to correspond to the through hole of the first piece and wherein the extension section has a through hole formed thereon to allow the catching member of the second piece to extend therethrough and engage the through hole of the first piece so as to secure the fastener to the extension section.

13. The cushion pad as claimed in claim 12, wherein the through hole of the extension section which receives the catching member of the second piece of the fastener therethrough comprises reinforcing ribs formed on the extension section and in the proximity thereof to prevent the through hole from being significantly deformed in connecting the head strip.

14. A cushion pad of a swimming goggle structure, the cushion pad comprising a ring portion having an inner circumferential slot formed thereon to receive a rib formed on a lens frame of the swimming goggle structure for holding the cushion pad on the lens frame and a face contact portion extending from the ring portion adapted to be in contact engagement with a wearer's face, the cushion pad comprising:

a connection means which comprises an extension section extending from an outer side of the cushion pad and having a substantial length terminating in a free end, a fastener being mounted on the free end to connect a head strip, and an auxiliary fastener securing the extension section of the cushion pads to the frame, the auxiliary fastener comprising a surface plate having an engaging pin to extend through holes formed on the frame and the extension section to be received and engaged by a slot formed on a back plate so as to secure the extension section to the frame.

15. The cushion pad as claimed in claim 13, further comprising an auxiliary fastener securing the extension section of the cushion pads to the frame, the auxiliary fastener comprising a surface plate having an engaging pin to extend through holes formed on the frame and the extension section to be received and engaged by a slot formed on a back plate so as to secure the extension section to the frame.

16. A swimming goggle structure comprising two frames each having a lens fixed thereon, two cushion pads, each cushion pad being mounted to one of the frames and adapted to contact a wearer's face, a bridge connecting inner sides of the frames and a head strip connecting outer sides of the frames, each of the frames having a ring formed on the outer side thereof, each of the cushion pads comprising a connection means which comprises an extension section extending from an outer side of the cushion pad and having a substantial length terminating in a free end, a fastener being mounted on the free end to connect the head strip, the cushion pad comprising an auxiliary fastener which comprises a surface plate configured to be snugly fit into the ring of the frame and having an engaging pin to extend through holes formed on the frame and the extension section to be received and engaged by a slot formed on a back plate.

17. The swimming goggle structure as claimed in claim 16, wherein the extension section extends from the cushion pad to a location close to an ear of the wearer.

* * * * *